US006694888B2

(12) United States Patent
Jopson et al.

(10) Patent No.: US 6,694,888 B2
(45) **Date of Patent: *Feb. 24, 2004**

(54) FRANGIBLE BULLET

(76) Inventors: Bill Jopson, 7865 Rio Vista Dr., Goleta, CA (US) 93117; Howard Davis, 5661 Marbury Dr., Goleta, CA (US) 93117

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/969,948

(22) Filed: Oct. 2, 2001

(65) Prior Publication Data

US 2004/0016356 A1 Jan. 29, 2004

(51) Int. Cl.[7] ..... F42B 10/00
(52) U.S. Cl. ..... 102/506; 102/509
(58) Field of Search ..... 102/506, 509

(56) References Cited

U.S. PATENT DOCUMENTS 1,303,727 A * 5/1919 Rice ..... 148/211
2,991,720 A * 7/1961 Dunlap et al. ..... 102/523
3,019,733 A * 2/1962 Braid ..... 102/529
3,726,495 A * 4/1973 Gawlick et al. ..... 102/503
3,820,464 A * 6/1974 Dixon ..... 102/493
4,044,685 A * 8/1977 Avcin ..... 102/508
4,048,922 A * 9/1977 Buljovcic ..... 102/509
4,068,590 A * 1/1978 Pearson ..... 102/493
4,108,074 A * 8/1978 Billing et al. ..... 102/529
4,175,492 A * 11/1979 Knappworst et al. ..... 102/503
4,665,827 A * 5/1987 Ellis, II ..... 102/510
5,214,237 A * 5/1993 McArthur ..... 102/501
5,291,833 A * 3/1994 Boual ..... 102/506
5,365,853 A * 11/1994 Petrovich et al. ..... 102/507
5,471,719 A * 12/1995 Sawyers ..... 102/508
5,763,819 A * 6/1998 Huffman ..... 102/510
6,349,651 B1 * 2/2002 Martinez Garcia ..... 102/501
6,546,875 B2 * 4/2003 Vaughn et al. ..... 102/507

* cited by examiner

*Primary Examiner*—Michael J. Carone
*Assistant Examiner*—M. Thomson
(74) *Attorney, Agent, or Firm*—Michael G. Petit

(57) ABSTRACT

A frangible hollow point bullet is disclosed. The bullet (or slug) is formed from a frangible material such as sintered copper to provide a bullet-shaped body. A plurality of coaxial, substantially cylindrical cavities having progressively decreasing bore diameters are formed in the nose of the bullet-shaped body, extending rearwardly therefrom, to provide a bullet that both expands and fragments in a semicontrolled fashion upon impact with a target. In a preferred embodiment, at least one of the coaxial cavities is multiply scored to provide a substantially symmetric fragmentation pattern and controlled and uniform fragment size. Controlling the aggregate depth of the coaxial cavities enables the retention of a recoverable base or shank that is suitable for ballistic investigation following bullet impact. Bullets and slugs, made in accordance with the present invention, have standard calibers and, when incorporated into conventional cartridges and shotgun shell casings respectively, may be fired at subsonic, sonic or supersonic velocities by conventional weapons.

5 Claims, 2 Drawing Sheets

FRANGIBLE BULLET

BACKGROUND OF THE INVENTION

1. Field of the Invention

The present invention relates generally to ammunition and more particularly to hollow point bullets or slugs comprising a cartridge or similar propulsion device.

2. Prior Art

Recent events, particularly the hijacking of airplanes by terrorists and the subsequent loss of life in New York, Pennsylvania and Virginia, have generated a need for new ideas for preventing airplane hijacking. For example, it has been proposed that one or more armed air marshals accompany scheduled airline flights to intervene in the event of an attempted hijacking. Another proposed solution is to arm pilots with weapons capable of selectively and accurately dispensing lethal force against a hijacker. A disadvantage with discharging a conventional weapon on an airplane wherein prior art bullets are the projectile is the danger posed by the bullet passing through the hijacker and striking another person or piercing the fusilage with concomitant loss of air pressure within the plane.

The nose portion of a hollow point bullet expands upon impact with a target media thereby increasing the energy transfer capabilities of the bullet. Typically, this expansion results in a number of petals of metal being formed as the nose portion folds back upon itself, thereby increasing the effective diameter of the bullet. This expansion and resultant petal formation is referred to as "mushrooming." A hollow point bullet may be solid or jacketed. A solid bullet typically comprises a solid piece of metal, such as lead or copper. A jacketed bullet typically comprises a lead core surrounded by a harder metal, such as brass. The jacket is relatively hard and slick, compared to the lead of the core, so the bullet is more resistant to mechanical deformation by the action of the gun as compared to the solid bullet.

Swank, in U.S. Pat. No. 5,943,749, discloses a bullet comprising a slug of generally solid material having an outer surface and an end portion having a cavity therein. A plurality of grooves are formed on the outer surface of the end portion. The end portion of the slug is contoured so that the bullet has a predetermined shape. A plurality of slits may be formed through at least a portion of each of the plurality of grooves. Preferably, the plurality of grooves and slits are formed substantially simultaneously. The slits are formed around a peripheral edge of the end portion of the slug. A plurality of projections, may be formed which extend into the cavity adjacent to the slits. Each of the slits may be formed at an angle with respect to a longitudinal axis of the slug to form each of the projections. The cavity in the end portion has a truncated cone geometry. Hollow Point (HP) projectiles can expand too quickly, resulting in poor penetration, or can only partially expand, leading to over penetration of a target and reduced energy transfer to the target. In addition, hollow point bullets can fail to expand, leading to severe over penetration or pass through.

Benini, in U.S. Pat. No. 6,263,798, discloses a frangible bullet and a method for making it. The frangible bullet is formed from a mixture of metal particles and metal or metalloid binder material which is compacted into the desired shape, heated to a temperature above that needed to form at least one intermetallic compound but below the temperature of joining of the metal particles by sintering and below the temperature of formation of substantial amounts of a ductile alloy of the metal of the particles and the metal or metalloid binder material and then cooled. When such articles are formed into bullets and fired at a target possessed of substantial mass, they have sufficient strength to maintain their integrity during firing but disintegrate into powder on impact. In addition, the bullet may comprise a variety of metals other than lead.

Huffman, in U.S. Pat. No. 6,115,894, discloses an armor-piercing frangible bullet, and provides a historic summary of bullet development as well as a summary of test data obtained for commercially available small arms ammunition. In particular applications it may be desirable to provide a hollow point, frangible bullet that can be subjected to ballistic inspection following impact with a target. Ballistic testing of a bullet requires that a substantial portion adjacent the base of a bullet (i.e., a shank) remain intact when presented for testing. Thus, it is desirable to provide a bullet that may be designed to possess attributes of both hollow point and frangible bullets and which, upon impact with a target, retains a recoverable shank of predetermined size that is suitable for ballistic characterization and identification.

Most ammunition projectiles, particularly the newer non-lead frangible projectiles, perform poorly in the sub-sonic range. Many ammunition manufacturers use high velocities to enhance the frangibility (break up) of the bullet upon impact. Prior art frangible projectiles can fail to fragment if the chemical process used to make the bullet is not carefully controlled. In addition, such frangible bullets operate best when fired at very high velocities, and are loaded by ammunition manufacturers at high pressures. Further, the fragmentation pattern is random and generally forms asymmetric clusters with respect to the direction of the primary wound channel.

While both frangible bullets and mushrooming hollow point bullets are known in the art, and wherein each has unique attributes that recommend it for specific situations, there continues to be a present and urgent need for improved bullets that can be fired by conventional weapons such as pistols and will minimize the danger of collateral damage in the event of a hijacking or similar situation wherein shoot-through injuries to innocent non-target people is probable.

SUMMARY

It is a primary object of the present invention to provide a frangible hollow point bullet adapted to be used in conventional small arms cartridges.

It is another object of the invention to provide a bullet meeting the primary objective, set forth above, wherein a shank portion of the bullet that is suitable for ballistic analysis is recoverable after impact of the bullet with a target.

It is a further object of the invention to provide a frangible hollow point bullet that fragments on impact with a target and wherein the size of the fragments is substantially controllable and uniform.

It is yet a further object of the invention to provide a frangible bullet that fragments upon impact with a target and wherein the spatial distribution of bullet fragments is substantially symmetric through a solid angle centered on the trajectory of the bullet prior to impact with the target.

The above objectives of the invention are met by a substantially bullet-shaped projectile having a leading end, a trailing end and a frangible body portion therebetween. The projectile has a hollow cavity opening onto the leading end of the body portion and extending rearwardly therefrom into the body portion. The hollow cavity comprises a plurality of coaxial cylindrical cavities, wherein the diameter of each rearwardly adjacent cylindrical cavity comprising the hollow cavity decreases stepwise, in discrete increments, in a direction rearward of said leading end. In a preferred embodiment of the projectile, at least one of the cylindrical cavities has a cavity wall bearing stress risers thereon. In a most preferred embodiment of the projectile, all of the cylindrical cavities comprising the hollow cavity have a pattern of stress risers on the wall thereof. Examples of suitable patterns of stress risers include a diamond-shaped pattern of grooves, a plurality of parallel grooves, a plurality of horizontal and or vertical grooves and so forth. The depth of the hollow cavity relative to the axial length of the projectile can be varied to control the fragmentation pattern and the size of the intact, recoverable base or shank. The inclusion if stress risers within the hollow cavity provides means for controlling fragment size upon impact. Preferred projectiles include bullets and shotgun slugs. In an embodiment of a shotgun slug having a hollow cavity in the rearward trailing end thereof, the wall of the hollow cavity includes stress risers thereon. The outer lateral surface of the projectile is preferably smooth. The leading end of the hollow cavity may be conically flared.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

DESCRIPTION OF THE PREFERRED EMBODIMENTS

Figure 1:
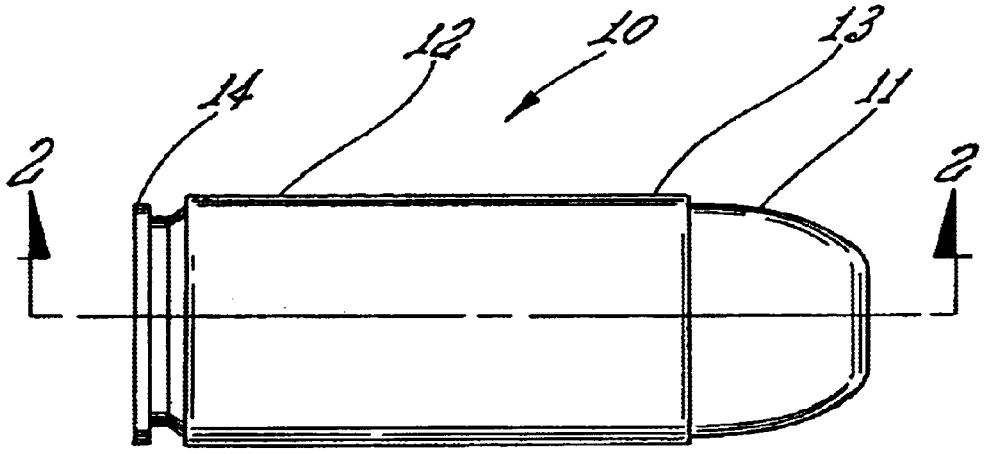
FIG. 1 is a side elevational view of a cartridge comprising a bullet in accordance with a first embodiment of the present invention.

A cartridge 10 comprising a frangible, three-cavity, hollow point bullet 11 in accordance with a three-cavity embodiment of the present invention is shown in side elevational view in FIG. 1. The cartridge 10 includes a case 12 encasing explosive material for expelling the bullet 11 from the case 12. The case 12 has a leading end 13 which houses the bullet 11 and a trailing end 14 housing a primer 21(FIG. 2) that explodes upon mechanical impact.

Figure 2:
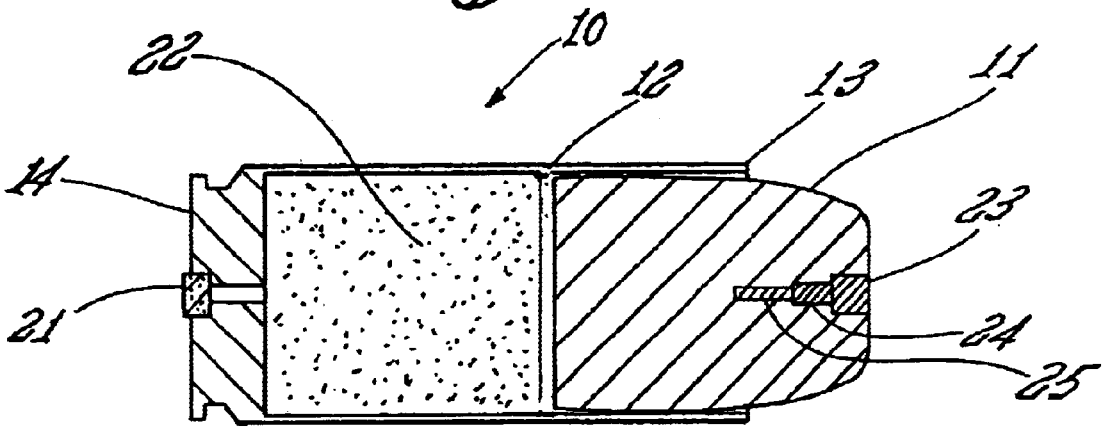
FIG. 2 is a cross-sectional view of the cartridge of FIG. 1 taken along section line 2—2 wherein the cartridge is center firing.
Figure 3:
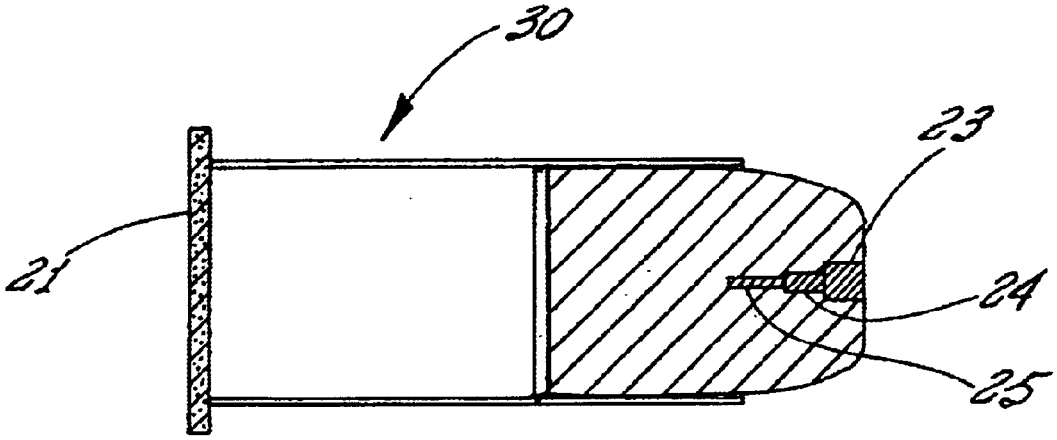
FIG. 3 is a cross-sectional view of the cartridge of FIG. 1 taken along section line 2—2 wherein the cartridge is rim firing.

Turning now to FIG. 2, the cartridge 10 of FIG. 1 is shown in cross-sectional view, taken along section line 2—2. If the cartridge 10 is center firing, the primer 21 is axially disposed on the trailing end 14 of the case 12 as shown. Forward of the primer is an explosive charge 22 such as gunpowder. A bullet 11 is pressure fitted into the leading end 13 of the case 12. The bullet 11 has three cylindrical, coaxial cavities in the nose thereof: an outer cavity 23, a middle cavity 24 and an inner cavity 25, the respective cavities having progressively smaller diameters. A rim fire cartridge 30 is shown in cross-sectional view in FIG. 3. The construction of the cartridge 30 is similar to the cartridge 10 of FIG. 1 except that primer 31 is incorporated into the trailing end 14 of the case.

Figure 4:
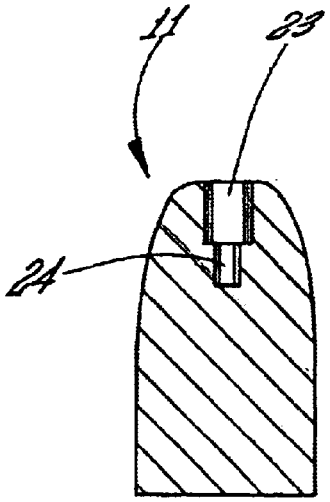
FIG. 4 is a cross-sectional view of a frangible hollow point bullet having two coaxial cavities in accordance with a two-cavity embodiment of the present invention.
Figure 5:
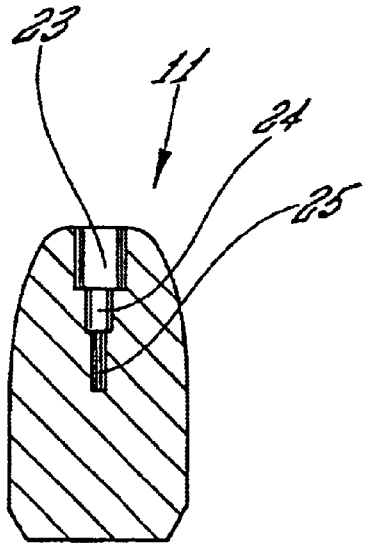
FIG. 5 is a cross-sectional view of a frangible hollow point bullet having three coaxial cavities in accordance with a three-cavity embodiment of the present invention.
Figure 6:
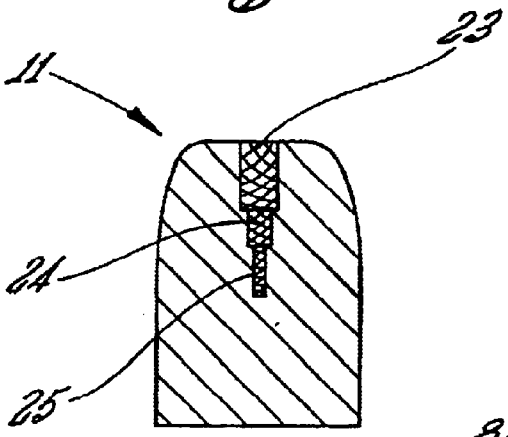
FIG. 6 is a cross-sectional view of a three-cavity embodiment of a frangible, hollow point bullet wherein the walls of the cavities have been skived to provide a grooved, diamond-like pattern thereon.
Figure 7:
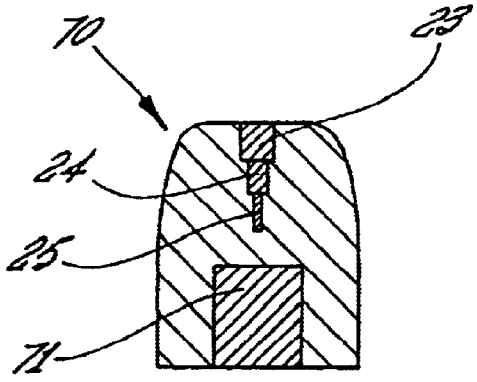
FIG. 7 is a cross-sectional view of a three-cavity frangible, hollow point shotgun slug wherein the three cavities have been skived by a tap to produce a plurality of parallel slanting grooves on the cavity walls.
Figure 8:
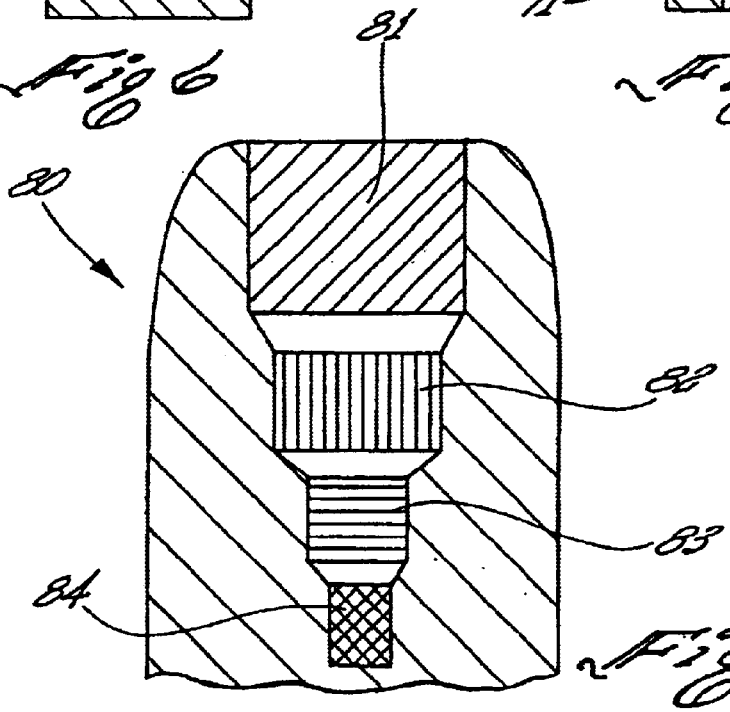
FIG. 8 is a cross-sectional view of a multicavity, frangible, hollow point bullet illustrating a variety of stress riser patterns skived on the respective cavity walls.

A key feature of all embodiments of the frangible bullet of the present invention is the presence of more than one coaxial cavity in the nose of the bullet, such as illustrated, for example, in FIGS. 4 and 5, and/or the presence of a scored pattern on the wall of at least one cavity. Prior art hollow point bullets, such as described earlier, have grooves on the outer surface of the nose of the bullet to provide controlled mushrooming. The present inventors have found that for hollow point frangible bullets, the fragmentation pattern can be controlled by skiving the wall of one or more of the cavities comprising the hollow point. The skived pattern may take any of the forms shown in FIGS. 6–8. FIG. 6 shows a three-cavity embodiment of a frangible, hollow point bullet having a diamond-shaped pattern skived on the cavity walls. FIG. 7 shows a three-cavity embodiment of a frangible, hollow point slug 70 for a shotgun shell bullet having a diagonal set of parallel grooves skived on the cavity walls and a diagonal set of parallel grooves in a rearward cavity 71. FIG. 8 illustrated a four-cavity embodiment 80 of a frangible, hollow point bullet having a pattern comprising a plurality of parallel diagonal grooves 81, a plurality of vertical grooves 82, a plurality of horizontal grooves 83 and a diamond-shaped pattern skived on the respective cavity walls. Of course When drilling, molding, or otherwise creating the cavities in a frangible bullet of the present invention wherein uniform fragment size is an important consideration, and the (multiple) cavities have different diameters and depths, the bore/depth ratio of the cavity is limited. If the cavities are drilled too deep, fragment size may be nonuniform, and the accuracy of the bullet is reduced. The use of multiple cavities in the nose of a bullet, each cavity having a moderate depth and bore diameter, provides a more uniform fragment size. In addition, by increasing the number of cavity sizes employed to create the hollow point, the greater the effectiveness of the stress risers (i.e., the pattern of grooves on the cavity walls) for controlling fragmentation of the bullet. Bullet stability (accuracy) can be adversely affected by an excessive number of cavities in order to minimize the size of the residual base or shank. Reduction of the residual base (shank) to a minimum mass (even to zero) cannot be achieved with multiple diameter holes, without a loss of bullet accuracy. The inclusion of stress risers on the interior wall of the cavity(ies) of a frangible bullet in accordance with the present invention, by scoring, forming or skiving a pattern of grooves thereon, greatly enhance the uniformity of fragment size upon impact. The leading end of the hollow cavity may be conically flared. A hollow point projectile having a hollow, axially symetric cavity that comprises three cylindrical cavities with decreasing bore diameters, that include stress risers on the cavity walls, provides a controllable breakup pattern as desired. Since the fragmentation of a frangible, multicavity hollow point bullet in accordance with the present invention will not substantially extend rearwardly of the axial cavity, the residual mass of the base (shank) can be determined by the total depth of the cavity.

The embodiments of a frangible bullet described herein allows consistent and controllable performance as to penetration, frangibility, and fragment size and shape for hollow point bullets comprised of various materials at sub-sonic, sonic, and super-sonic velocities and in various ammunition types. The frangible bullet/projectile in accordance with the present invention may comprise, but is not limited to: (a) any sintered, unsintered, cold compacted, cast, or cured bullets. Frangible, hollow point bullets in accordance with the present invention have an axially symmetric hollow cavity comprising a pattern of intersecting (diamond pattern) and/or non-intersecting stress risers skived or otherwise formed on the cavity wall. The shape of the nose cavity and pattern of the stress risers can be used to pre-determine fragment size, fragmentation pattern and action. In addition, the leading end of the hollow cavity may be conically flared without departing from the scope of the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A substantially bullet-shaped projectile consisting of a body having a leading end, a trailing end and a frangible body portion therebetween, and a plurality of cavities having cylindrical walls extending rearwardly into said body portion from said leading end, the diameter of said cylindrical walls of each cavity comprising said plurality of cavities being progressively smaller in a direction rearward of said leading end and a plurality of intersecting stress risers on said cylindrical wall of at leg one of said plurality of cavities wherein said projectile disintegrates into a plurality of fragments upon impact with a target and wherein said plurality of intersecting stress risers are a pattern of intersecting grooves, said pattern of grooves being operable for determining the size and/or shape of fragments formed upon impact of said projectile with said target.

2. The projectile of claim 1 wherein said projectile is a bullet.

3. A projectile in accordance with claim 1 wherein said body portion has a smooth outer surface.

4. A cartridge comprising a projectile in accordance with claim 1.

5. A substantially bullet-shaped projectile consisting of a body having a leading end, a trailing end and a frangible body portion therebetween, and a cavity having a cylindrical wall extending rearwardly into said body portion from said leading end, and a plurality of intersecting grooves forming stress risers on said cylindrical wall of said cavity wherein said projectile disintegrates into fragments upon impact with a target and wherein said plurality of intersecting grooves form a pattern that determines the size and/or shape of fragments produced upon impact of projectile with a target.

* * * * *